US005803319A

United States Patent [19]

Smith et al.

[11] Patent Number: 5,803,319

[45] Date of Patent: Sep. 8, 1998

[54] INVERTIBLE SPRAY VALVE AND CONTAINER CONTAINING SAME

[75] Inventors: Jeremy Smith, Loudon; Walter Richard Gallien, Raymond, both of N.H.

[73] Assignee: Summit Packaging Systems, Inc., Manchester, N.H.

[21] Appl. No.: 609,951

[22] Filed: Feb. 29, 1996

Related U.S. Application Data

[63] Continuation-in-part of Ser. No. 589,036, Jan. 19, 1996.

[51] Int. Cl.[6] ..... B65D 83/00

[52] U.S. Cl. ..... 222/402.19; 222/402.24; 222/402.25

[58] Field of Search ..... 222/376, 402.19, 222/402.24, 402.25, 464.1

[56] References Cited

U.S. PATENT DOCUMENTS

| | | | |
|---|---|---|---|
| 3,315,693 | 4/1967 | Braun | 137/43 |
| 3,542,254 | 11/1970 | Samuelson et al. | 222/402.19 |
| 4,572,406 | 2/1986 | Pratt et al. | 222/402.19 X |
| 4,669,273 | 6/1987 | Fischer et al. | 62/294 |
| 4,723,692 | 2/1988 | Meuresch et al. | 222/402.19 |
| 4,775,079 | 10/1988 | Grothoff | 222/321 |
| 4,940,170 | 7/1990 | Popp-Ginsbach | 222/402.1 |
| 4,942,985 | 7/1990 | Schultz | 222/376 |
| 4,978,038 | 12/1990 | Sullivan | 222/402.19 |
| 5,186,201 | 2/1993 | Warren | 137/38 |
| 5,222,636 | 6/1993 | Meuresch | 222/321 |
| 5,350,088 | 9/1994 | Smith | 222/402.19 |
| 5,462,209 | 10/1995 | Foster et al. | 222/376 |

FOREIGN PATENT DOCUMENTS

| | | |
|---|---|---|
| 440855 | 8/1991 | European Pat. Off. . |
| 2058229 | 4/1981 | United Kingdom . |

*Primary Examiner*—Joseph Kaufman
*Attorney, Agent, or Firm*—Davis and Bujold

[57] ABSTRACT

A valve having a valve body, defining a longitudinal axis, with a circular side wall extending down beyond a floor of the body to define a socket. Into this socket is frictionally engaged an appendage having a circular upper end and a nipple at its lower end. The appendage is partitioned into a primary product passage, communicating with a product outlet extending through the floor of the valve body, and a ball chamber, the lower of which is provided with a valve seat with a bypass opening communicating with the primary product passage. A ball chamber passage is formed in the ball chamber above the valve seat and a ball is normally seated, via gravity, on the valve seat when the container is in a normal upright position. When the container is inverted, the ball drops away from the seat and permits passage of product through the ball chamber passage, through the bypass opening into the primary product passage and up into the valve body for discharge. At least one of a ball chamber longitudinal axis and a ball chamber plane is inclined relative to the longitudinal axis defined by the remainder of the valve to alter the degree of permissible tilt of a container containing the valve before the ball becomes unseated.

16 Claims, 8 Drawing Sheets

INVERTIBLE SPRAY VALVE AND CONTAINER CONTAINING SAME

This application is a continuation-in-part application of U.S. patent application Ser. No. 08/589,036 filed Jan. 19, 1996 still pending.

BACKGROUND OF THE INVENTION

1. Field of the Invention

This invention relates to an improved spray valve, e.g. an aerosol valve, a tilt valve, a pump spray valve, or a trigger spray valve, for use in dispensing product from an container. Specifically, the invention relates to a valve having a valve body with a lower portion including a ball chamber having a gravity-responsive ball therein which enables the valve to be used with either end up.

2. Related Prior Art

A prior art aerosol valve is shown in FIGS. 1 and 2 and is generally designated 10 (U.S. Pat. No. 5,350,088). It comprises a body 12 which is generally cup-shaped and has a thickened mouth 14 with castellations there-around, a side wall 16 and a floor 18. The side wall 16 extends down below the floor 18 to define a socket 20 which has a reduced mouth 22. The body defines a longitudinal axis L of the valve.

Across the top of the body is disposed an annular gasket 24 which is clamped in position by having the pedestal 26 of a mounting cup crimped radially inward against the underside of the thickened mouth 14. The top 30 of the pedestal clamps against the top of the gasket 24. Locator ribs 32 are molded into the inside of the body 12 between the floor 18 and the side wall 16. These serve to strengthen the floor and center the lower end of a spring 34. The floor 18 is provided with a product outlet 35.

A valve element 36 is defined by a tubular upward stem 38 having passage means 40 in the form of radial ducts. An enlarged head 42 is formed at the lower end of the valve element and is centrally connected to the tubular stem 38. An annular recess 44 is provided in the underside of the head, and the upper end of the head may be formed with an annular sealing ring 46 which seats against the gasket 24. The passage means 40 are adjacent the head 42 and normally closed off by the gasket 24 when the valve element is in its biased upper position. The compression spring 34 is compressively disposed between the floor 18 and the recess 44 to urge the valve element upward.

An appendage 50 has a circular side wall 52 thickened outwardly at its upper end at 54 where it frictionally and sealingly engages in the socket 20. The reduced mouth 22 and thickened portion 54 serve as detent formations to retain the appendage 50 in the socket 20. The side wall 52 is vertically partitioned by an inner partition wall 56 into a primary product passage 58 and a ball chamber 60. The ball chamber 60 is formed at its lower end with a conical ball chamber seat 62 having a central ball chamber bypass opening 64. The side wall 52 of the appendage has a ball chamber passage 66 in the area of the ball chamber above the ball chamber seat 62. The ball chamber 60 defines a longitudinal axis M which extends parallel to the longitudinal axis L.

As shown in FIG. 1, the side wall 52 of the appendage tapers downward inwardly at 68 and connects with a dip tube tailpiece or nipple 70. The nipple 70 is tubular and the upper end communicates with both the primary product passage 58 and the bypass opening 64. The ball chamber 60 is provided with a gravity-responsive ball chamber ball 72 which normally rests (FIG. 1) on the ball chamber valve seat 62 closing off ball chamber bypass opening 64.

The upper end of the ball chamber 60 is typically sealed against the floor 18, e.g. the upper end of the partition 56, and the adjacent arcuate portion of the appendage side wall 52 is formed with an upward circular rib 74. The underside of the floor is formed with an annular downward boss (not shown) and when the appendage is inserted in the socket 20, the rib 74 presses continuously around the underside of boss 76. The upper end of the side wall 52 of the appendage 50 is formed with a chamfered edge 78. Chamfered edge 78 serves as a lead-in for the appendage when it is being installed past the mouth 22 of the socket 20.

During assembly, the outlet 35 in the valve body floor 18 lines up with the primary product passage 58 in the appendage and the boss 76 lines up with the rib 74. During normal right-side-up operation (FIG. 1), when the actuator button 92 is depressed and the valve is open, the product passes up the dip tube into the nipple 70 (flow line A) through the product passage 58, outlet 35 and into the valve body 12. The sealing ring 46 is spaced down away from the gasket 24 and product passes through the passage means 40 (located down below the gasket 24), into the tubular stem 38 and out the actuator button orifice 95.

With the container and valve inverted as shown in FIG. 2, the path of the product (flow line B) is different. The product enters through the ball chamber passage 66 into the ball chamber 60, passes through the ball chamber bypass opening 64 into the nipple 70 and down into the passage 58 and through outlet 35 into the valve body 12. The product will then pass around the head 42 and into the passage means 40 which are located above the gasket 24 (when the actuator button is depressed). From thence the product passes through the tubular stem 38 and out the orifice 95 of the actuator button.

This known prior art aerosol valve, however, has some associated drawbacks. In particular, such known valve does not function as desired when an aerosol container containing the prior art aerosol valve is oriented in a substantially horizontal position. When the prior art valve is in a substantially horizontal position and operated to discharge product, a portion of the product passing through the nipple 70 is diverted by the partition wall 56 into ball chamber bypass opening 64. The pressure of the diverted portion of the product contacts the ball 72 and overcomes the force of gravity thereby prematurely unseating the ball 72 and unsealing the ball chamber bypass opening 64. As a result of such ball 72 movement, propellant located in the upper portion of the container may unintentionally enter ball chamber passage 66, ball chamber 60 and ball chamber bypass opening 64 and flow into the primary product passage 58. The propellant thereafter exits the valve 10 by the conventional product flow path. The propellant entering ball chamber passage 66 may or may not convey some of the product P with it.

Inadvertent discharge of propellant, either alone or with a minor amount of product, is commonly referred to as "vapor tapping", which is generally to be avoided as undesirable. "Vapor tapping" causes premature loss of propellant and generally shortens the life of the aerosol container. With pump spray valves and trigger spray valves, "vapor tapping" is not a problem but the valve will discharge air instead of product when the valve is in the inverted position and actuated.

SUMMARY OF THE INVENTION

Wherefore, it is an object of the present invention to overcome the aforementioned problems and drawbacks associated with the prior art designs by minimizing the possibility of "vapor tapping" occurring while ensuring product being dispensing from a container.

Another object of the invention is to provide a valve which can be used in a variety of upright positions as well as a substantially horizontal spraying position, without propellant or air becoming inadvertently discharged from the container.

A still further object of the invention is to provide an improved valve which is suitable for discharging household products, such as furniture polish, cleaners, disinfectants, etc., which insures that generally only the product contents of the container is discharged.

Yet another object of the invention is to increase the range of permissible forward tilt of a container before any "vapor tapping" or inadvertent air discharge will occur.

Another object of the invention is to provide a spray valve for a container which insures that a desired portion of the product contents of the container is discharged with each activation of the valve when the container is in conventional spraying orientations.

Still another object of the invention is to provide a valve which is easy to manufacture and can be produced in a two-part mold in a single separating action.

The present invention relates to an invertible valve comprising a valve body accommodating a valve element for controlling flow through the valve, the valve body defining a valve body longitudinal axis, the valve element having passage means for discharging product from the valve when the valve is opened, the valve body including a lower portion having a ball chamber and a valve inlet product passage, the ball chamber being provided with a ball chamber passage and a ball chamber bypass valve seat having a ball chamber bypass opening, a lower end of the product passage communicating with the ball chamber bypass opening while an upper end thereof communicating with the valve element, and a gravity-responsive ball chamber ball being provided in the ball chamber and normally seating on the ball chamber seat, the ball chamber providing an area for accommodating the ball when the ball becomes unseated from the ball chamber seat, a perimeter contact between the ball chamber seat and the ball, when the ball is supported thereby, defining a ball chamber plane, and the ball chamber ball moving from the ball chamber seat when the valve is inverted to permit passage of product through the ball chamber passage, through the ball chamber bypass opening, through the product passage into the valve body and out the passage means when the valve is opened; wherein the ball chamber plane is inclined relative the valve body longitudinal axis at an angle of between from about 1° to about 89°.

The present invention also relates to a container including the improved invertible valve according to the present invention.

Lastly, the present invention relates to a method of forming an invertible valve comprising the steps of accommodating, within a valve body, a valve element for controlling flow through the valve, the valve body defining a valve body longitudinal axis; providing passage means in the valve element for discharging product from the valve when the valve is opened, the valve body including a lower portion having a ball chamber and a valve inlet product passage; providing the ball chamber with a ball chamber passage and a ball chamber bypass valve seat having a ball chamber bypass opening, a lower end of the product passage communicating with the ball chamber bypass opening while an upper end thereof communicating with the valve element; accommodating a gravity-responsive ball chamber ball in the ball chamber and normally seating the ball on the ball chamber seat, the ball chamber providing an area for accommodating the ball when the ball becomes unseated from the ball chamber seat; defining a ball chamber plane by a perimeter contact between the ball chamber seat and the ball, when the ball is supported thereby; inclining the ball chamber plane relative the valve body longitudinal axis at an angle of between from about 1° to 89°; and the ball chamber ball moving from the ball chamber seat when the valve is inverted to permit passage of product through the ball chamber passage, through the ball chamber bypass opening, through the product passage into the valve body and out the passage means when the valve is opened.

BRIEF DESCRIPTION OF THE DRAWINGS

The invention will now be described, by way of example, with reference to the accompanying drawings, in which.

DESCRIPTION OF THE PREFERRED EMBODIMENTS

Figure 3:
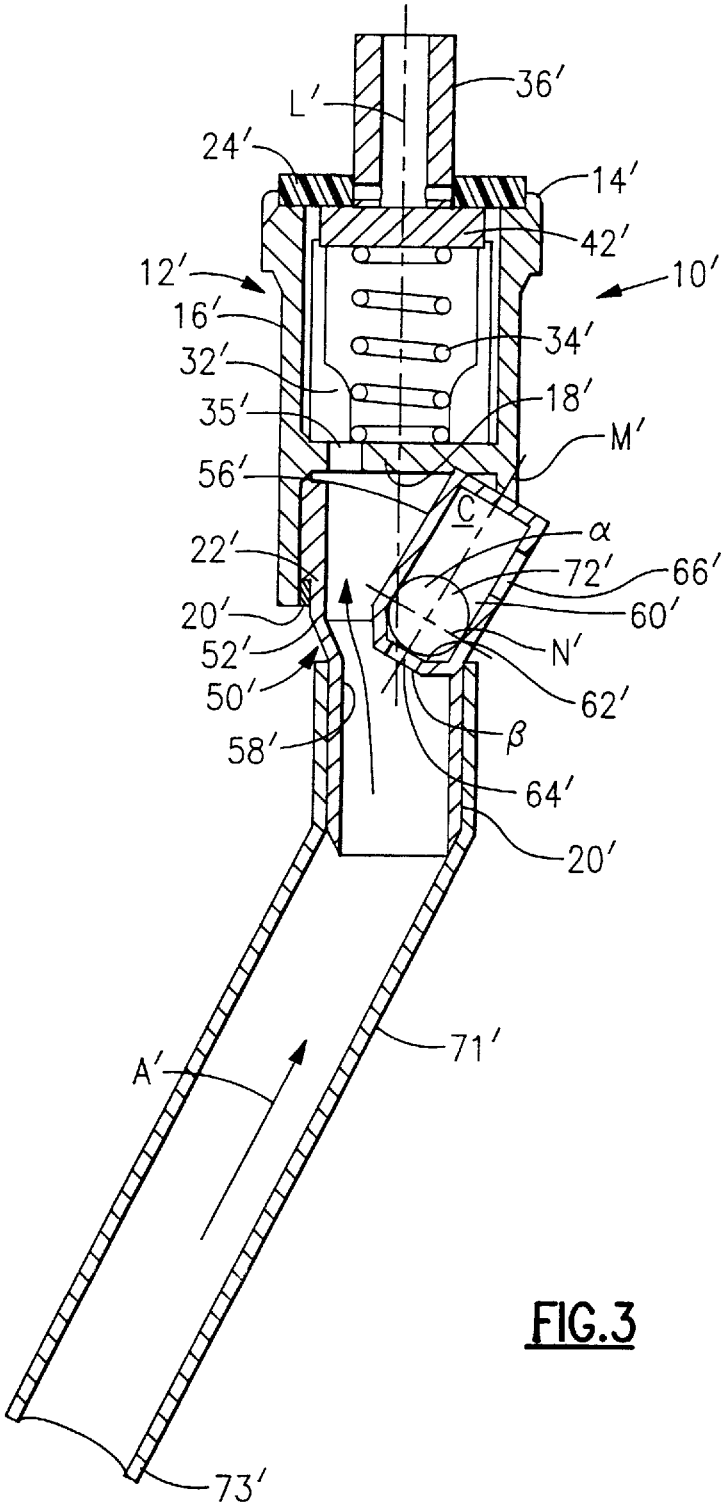
FIG. 3 is partial cross-sectional view showing an improved valve, in a vertical upright position, embodying the present invention.
Figure 4:
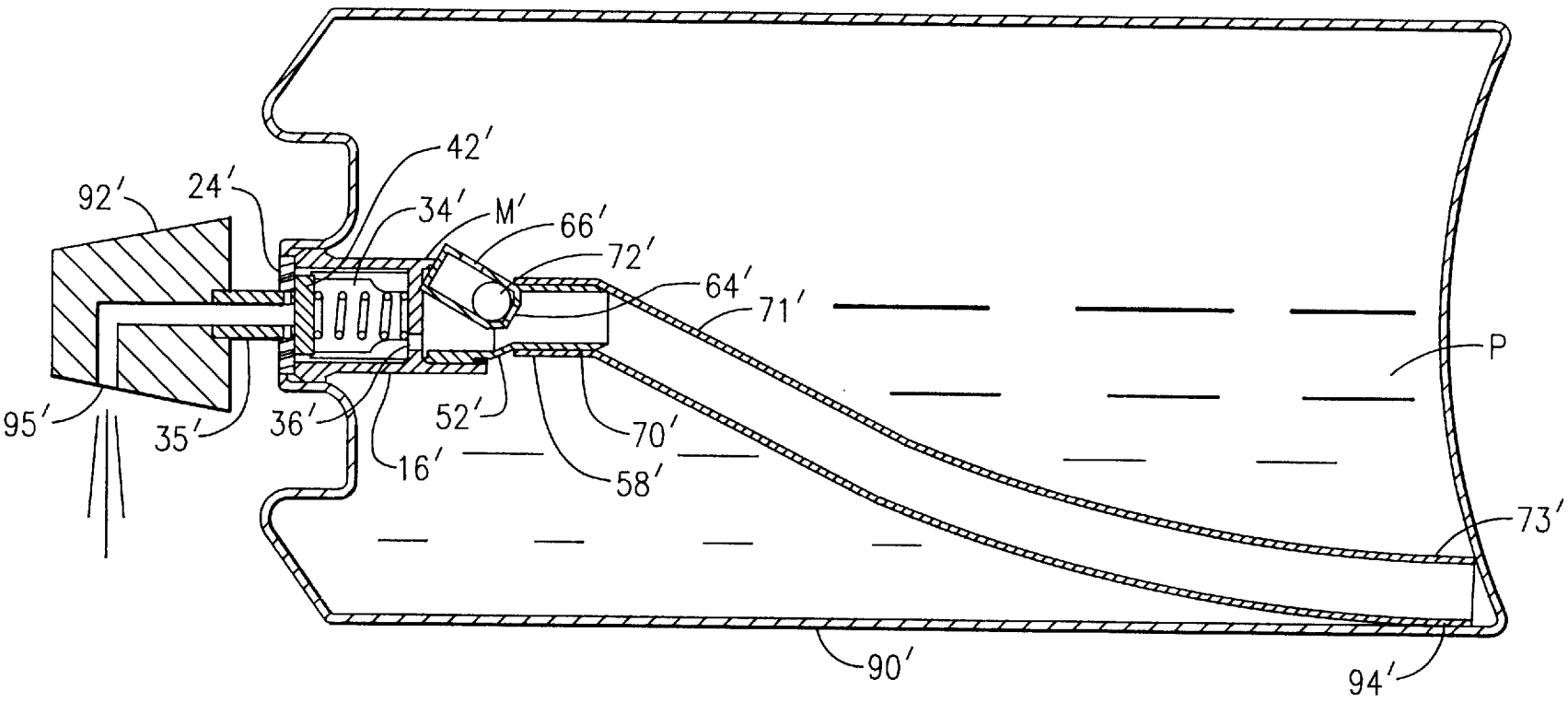
FIG. 4 is a diagrammatic section showing the valve of FIG. 3 in combination with a container, shown diagrammatically, in a substantially horizontal position.
Figure 5:
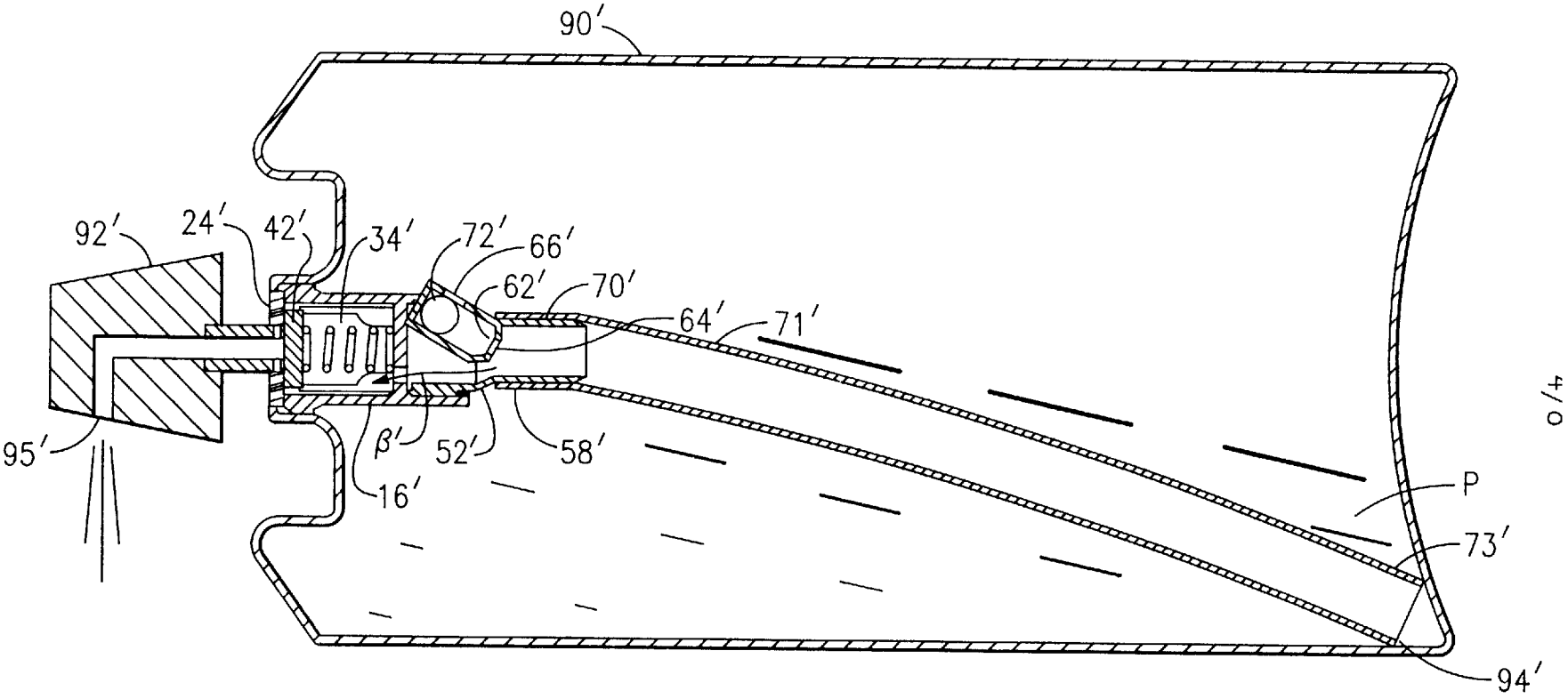
FIG. 5 is a view similar to FIG. 4 but showing the container in an slightly inverted position.

Turning now to FIGS. 3–5, a detailed description concerning the present invention will now be provided. In the following description and the appended claims, the terms such as "upward" and "upper" and "downward" and "lower" refer to relationships and directions when the valve is in the right-side-up position of FIG. 3. The term "forward tilt" refers to rotating the container (FIG. 4) counter-clockwise about its center point in the plane of the paper while the term "rearward tilt" refers to rotating the container (FIG. 4) clockwise about its center point in the plane of the paper.

Figure 1:
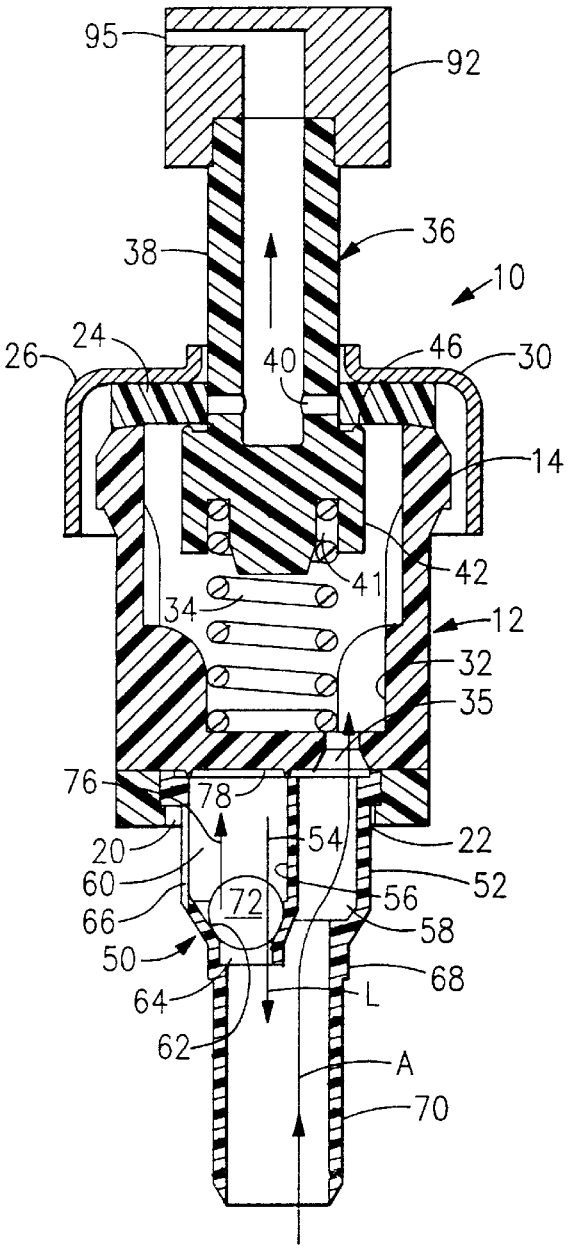
FIG.1 Prior Art
FIG. 1 is a center line section showing a prior art valve installed in a container which is only fragmentally shown.
Figure 2:
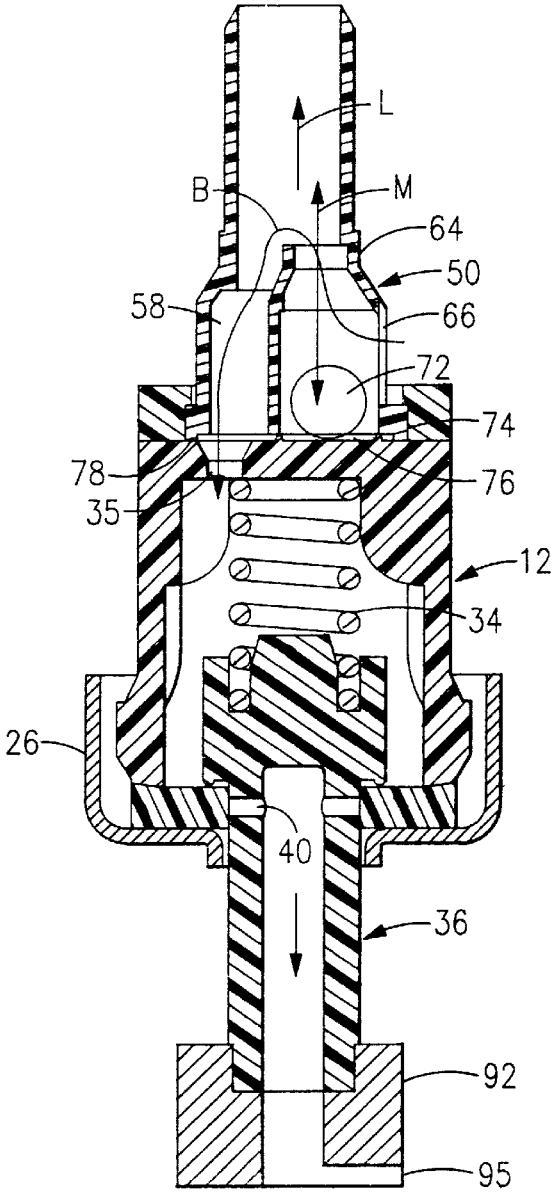
FIG.2 Prior Art
FIG. 2 is a view similar to FIG. 1 of a prior art device but showing the container in an inverted position.

The valve 10' shown in FIG. 3 is similar to the previously discussed prior art valve (FIGS. 1 and 2) and comprises a generally cup-shaped body defining a longitudinal axis L' and has a thickened mouth 14' with castellations therearound, a side wall 16' and a floor 18'. The side wall 16' extends down below the floor 18' to define a socket 20' which has a reduced mouth 22'. Locator ribs 32' are molded into the inside of the body between the floor 18' and the side wall 16'. The floor 18' is provided with a product outlet 35'.

A bypass appendage 50' forms a lower portion of the valve and has a substantially circular side wall 52' which is frictionally and sealingly engaged in the socket 20'. The appendage 50' is partitioned, by an inner partition wall 56', into a primary product passage 58' and an inclined ball chamber 60'. The ball chamber 60' defines a ball chamber longitudinal axis M' that intersects with longitudinal axis L' and forms therewith an angle $\alpha$ of from about 1° to about 89°. Preferably, angle $\alpha$ is from 10° to about 80°, more preferably angle $\alpha$ is from about 20°0 to about 50°, and most preferably angle $\alpha$ is about 30°.

A lower end of the ball chamber 60' is provided with a conical ball chamber seat 62' having a central ball chamber bypass opening 64'. A ball chamber passage 66' extends through the side wall 52', above the ball chamber seat 62', into the ball chamber 60'. The ball chamber 60' is provided with a gravity-responsive ball chamber ball 72' which normally rests (FIGS. 3 and 4), under the force of gravity, on the ball chamber valve seat 62' closing off ball chamber bypass opening 64'. A perimeter contact between the ball chamber seat 62' and the ball 72', when the ball 72' is supported by the seat, defines a ball chamber plane N'. The angle formed by ball chamber plane N' with respect to the longitudinal axis L of the valve (angle $\beta$) is a complementary angle to the angle formed between longitudinal axis M and the longitudinal axis L of the valve (angle $\alpha$). This complementary angle $\beta$ is typically from about 89° to 1°, preferably about 80° to 10°, more preferably 70° to 40° and most preferably about 60°.

The side wall 52' of the appendage 50' tapers inwardly 68' (FIG. 3) and connects with a dip tube tail-piece or nipple 70' for receiving an upper end of a dip tube 71' (FIGS. 4 and 5). The nipple 70' is tubular and the upper end communicates with both the primary product passage 58' and the ball chamber bypass opening 64'. A lower end of the dip tube 73' communicates with a forward, relative to the direction of spray, lower corner 94' of the container 90' (diagrammatically illustrated in FIGS. 4 and 5).

As can be seen in FIG. 3, due to the inclination of the ball chamber 60' relative to the remainder of the valve 10', the exterior sidewall 52' is not completely circular. The exterior sidewall 52', in the area of the ball chamber 60', contains an outwardly extending protrusion (not numbered) which provides an area or cavity C' for accommodating the ball 72' (FIG. 5) once it is moved off the ball chamber seat to allow product P to flow through ball chamber passage 66'. The end portion of the ball chamber 60', remote from the ball chamber seat 64', may be either unsealed but designed to captively retain the ball 72', e.g. contain an inwardly projecting detent, or sealed so that the only permissible product flow path is via ball chamber passage 66' and ball chamber bypass opening 64', once the ball 72' is unseated.

When the valve 10' is operated in the usual vertical upright position (FIG. 3) by depressing the actuator button 92', the product P follows along a primary flow path, designated A, through dip tube 71', 73', nipple 70', passage 58', outlet 35', valve body 12', and valve element 36', and out the spray button orifice 95'. This product flow path is maintained even when the contained is oriented substantially horizontal with the spray button orifice 95' directed vertically downward (FIG. 4). Due to the inclined orientation of the ball chamber longitudinal axis M' and the ball chamber plan N' relative to the valve body longitudinal axis L', the ball 72', unlike the ball 72 of the prior art valve 10, still remains seated on the ball chamber valve seat 62' under the force of gravity and the ball chamber bypass opening 64' remains sealed by the ball 72'. Thus, the product continues to flow into the lower end 73' of the dip tube along the primary flow path A since the lower end 73' of the dip tube is still positioned in the lower forward portion of the container beneath a top surface of the product P contained within the container 90'. If a conventional prior art valve was installed in a container and oriented in position shown in FIG. 4, the ball 72 would be unseated and propellant gas or air would enter ball chamber passage 66, which is located above a top surface of the product P and be directly discharged by the valve 10, thereby causing "vapor tapping" or air discharge. The present arrangement prevents this drawback.

As with the prior art aerosol valve, when the container including the valve according to the present invention is sufficiently inverted, e.g. inclined forward greater than a horizontal position (FIG. 5), the ball 72' moves away from its ball chamber valve seat 62' thereby unsealing the ball chamber bypass opening 64'. In this position, the product now enters through ball chamber passage 66' (which is now located beneath the top surface of the product P), ball chamber 60', ball chamber bypass opening 64', nozzle 70', product passage 58', outlet 35' valve element 12' and out the orifice 95' of the actuator button along the secondary flow path B'.

Once product has been discharged at least once by the container, the dip tube is generally completely filled with product P. The product P located within the dip tube minimizes the possibility of propellant or air entering the remote end of the dip tube and being inadvertently discharged when the container is in an inverted position.

It is important to note that the orientation of the ball seat 62', the lower end of the dip tube 73' and the orifice 95' of the actuator button are critical to insure proper operation of the valve made according to the present invention. Accordingly, the inlet to the lower end of the dip tube 73' as well as the outlet of the orifice 95' of the actuator button 92' and the longitudinal axis of the ball chamber M' should all substantially lie in a plane defined by the sheet of paper containing FIGS. 4 and 5 or closely adjacent that plane. When those three components are so arranged, proper operation of the valve is assured. If proper orientation of these components is not achieved during assembly of the container, inadvertent "vapor tapping" or air discharge instead of product may occur during use.

Figure 6:
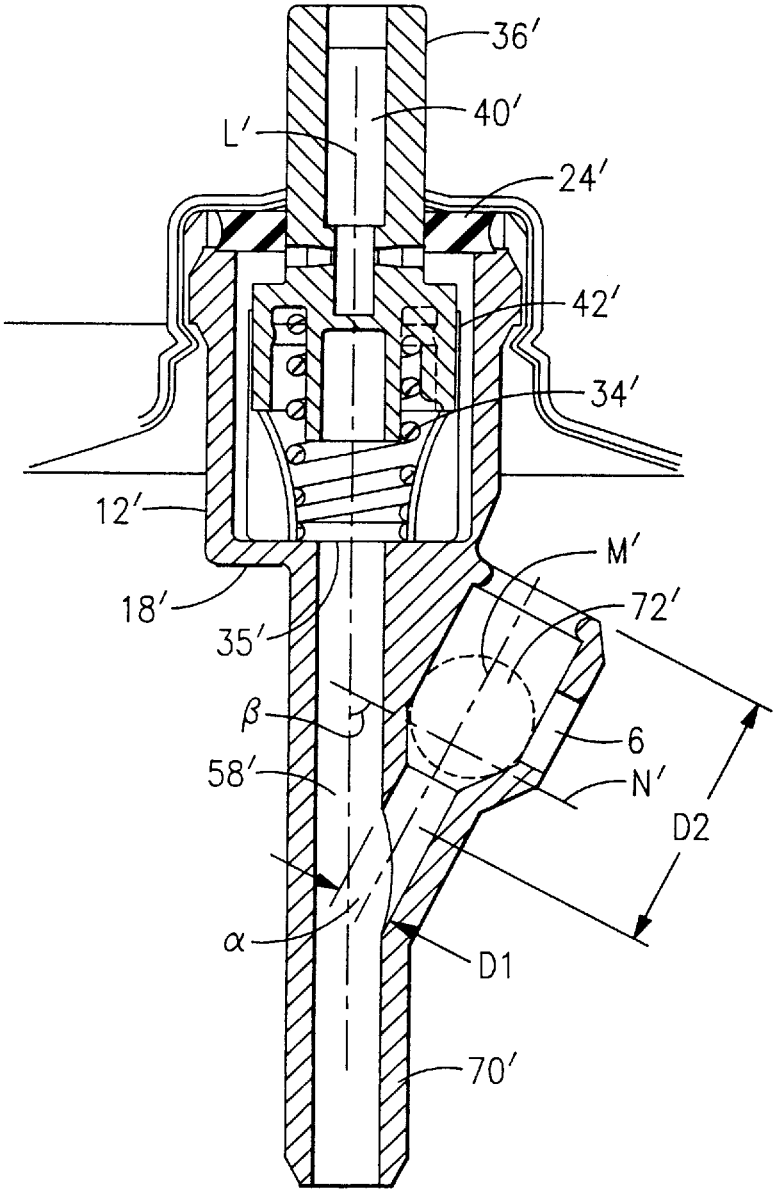
FIG. 6 is a diagrammatic cross-sectional view showing a second embodiment of the improved valve, according to the present invention, in which the valve body and the appendage are formed as a single unitary structure.

With reference to FIG. 6, a modification of the embodiment shown FIG. 3 is disclosed. According to this embodiment, the lower portion of the valve body 12' and the product passage 58', including the ball chamber 60', are formed as a single component as part of the valve body 12'. The ball chamber 60' has a length D2 of about 0.337 inches and a bypass opening diameter D1 of about 0.070 inches. This simplified construction eliminates the need to form a socket in the lower portion of the valve body 12' and provide a separate appendage which has an upper portion received by the socket. As the remaining elements of this embodiment are the same as those discussed above, a further detailed description concerning the same is not provided.

Figure 7:
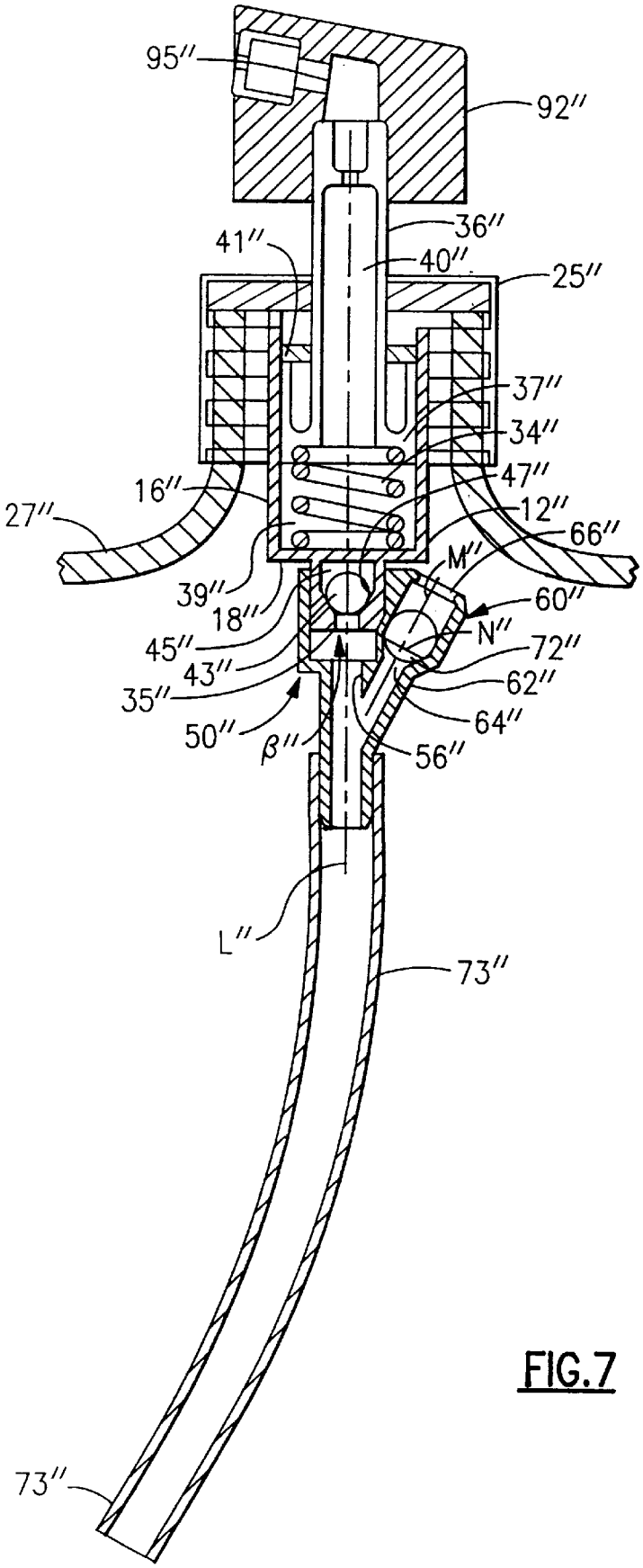
FIG. 7 is cross-sectional view showing a third embodiment of the improved valve, in a vertical upright position, embodying the present invention and incorporated as part of a valve for a finger spray pump.

Turning now to FIG. 7, a detailed description concerning a finger spray pump, embodying the improvement of the present invention, will now be described. In this embodiment, a closure or cap 25" is typically provided with an internal thread which is threadingly engaged with an exterior thread of an opening of a container 27" containing the product to be dispensed. The closure 25" supports a valve body 12" which includes a sidewall 16" and a floor 18". A piston 37" is located within an interior cavity 39" of the valve body 12" and is biased, by spring 34", into a raised upper position away from the floor 18" against a stop 41". The flow of product through the valve body 12" is controlled by a ball valve 43" captively located within a ball valve chamber 45". The ball valve 43", when in its closed position, is seated on a conical ball valve seat 47" so as to prevent the flow of product from the dip tube toward the actuator button 92". When the ball valve 43" becomes unseated from valve seat 47", product is allowed to flow pass ball valve 43". The valve body 12" defines a longitudinal axis L" of the valve.

The piston 37" is provided with passage means 40" for supplying the product from the cavity 39" to the actuator button 92". The actuator button 92" is provided with an outlet orifice 95" which communicates with passage means 40" for dispensing the product from the container.

An appendage 50" is secured to a lower portion of the valve body 12". According to this embodiment, an outer surface of the lower portion of the valve body 12" is received by the product passage 58". The lower portion of the valve body 12" may have a slight interference fit with the product passage 58" of the appendage 50" or may be secured thereto by glue or some other adhesive or attachment member. The lower most portion of the valve body 12" is provided with a product outlet 35" which communicates with the product passage 58".

As with the previous embodiment, the appendage 50" is partitioned, by an inner wall 56", into the product passage 58" and an inclined ball chamber 60". The ball chamber 60" defines a longitudinal axis M" that intersects with the longitudinal axis L" and forms therewith an angle $\alpha$ of from about 1° to about 89°. Preferably, angle $\alpha$ is from about 10° to about 80°, more preferably angle $\alpha$ is from about 20° to about 50°, and most preferably angle $\alpha$ is about 30°.

A lower end of the ball chamber 60" is provided with a conical ball chamber seat 62" having a central ball chamber bypass opening 64". The perimeter contact between the ball chamber seat 62" and the ball 72", when the ball 72" is supported by the seat, defines a ball chamber plane N". In this embodiment as well as the embodiment of FIG. 3, the longitudinal axis M" extends normal to the ball chamber plane N". A first end of a dip tube 71" is connected a lower end of the appendage 50" to supply product to be dispensed to the valve. The angle formed by ball chamber plane N" with respect to the longitudinal axis L" of the valve (angle $\beta$) is a complementary angle to the angle formed between longitudinal axis M" and the longitudinal axis L" of the valve (angle $\alpha$). This complementary angle $\beta$ is typically from about 89° to 1°, preferably about 80° to 10°, more preferably 70° to 40° and most preferably about 60°.

During use, upon depression by a user of the actuator button 92" along longitudinal axis L" toward the closure 25", the product contained within the cavity 39" of the valve body 12" is compressed and forced along the passage means 40", formed in a stem of the piston 37", out through the actuator button 92" and its associated orifice 95". At the end of the depression stroke of actuator button 92, the spring 34" biases the piston 37" away from the floor 18". During this spring biasing action, the ball valve 43" is moved away from its ball valve seat 47" so that additional product is sucked or conveyed into the cavity 39" formed between the valve body 12" and a lower end of the piston 37". Once the piston 37" is fully biased by the spring 34" against the stop 41", the sucking action ceases and the ball valve 43" again seats upon the ball valve seat 47", under the force of gravity, so that upon further a depression of the actuator button 92" product in cavity 39" will be compressed and dispensed in the above indicated manner.

In the case of non-pressurized spray valves, the appendage 50" carrying the ball chamber 60" will typically either be secured to or formed as a lower part of the valve body 12" or be inserted at the connection between the lower portion of the valve body 12" and an upper end of the dip tube. Such insertion will facilitate product being sucked into the cavity 39", via the secondary flow path B", once the gravity-responsive ball chamber ball 72" moves away from the ball chamber valve seat 62" thereby unsealing the ball chamber bypass opening 64". When the ball 72" is in its unseated position, product now enters through ball chamber passage 66" (which is now located beneath the top surface of the product P when the valve is inverted), ball chamber 60", ball chamber bypass opening 64", primary product passage 58", outlet 35", past ball valve 43" into valve body 12" and out through orifice 95" of the actuator button 92".

Figure 8:
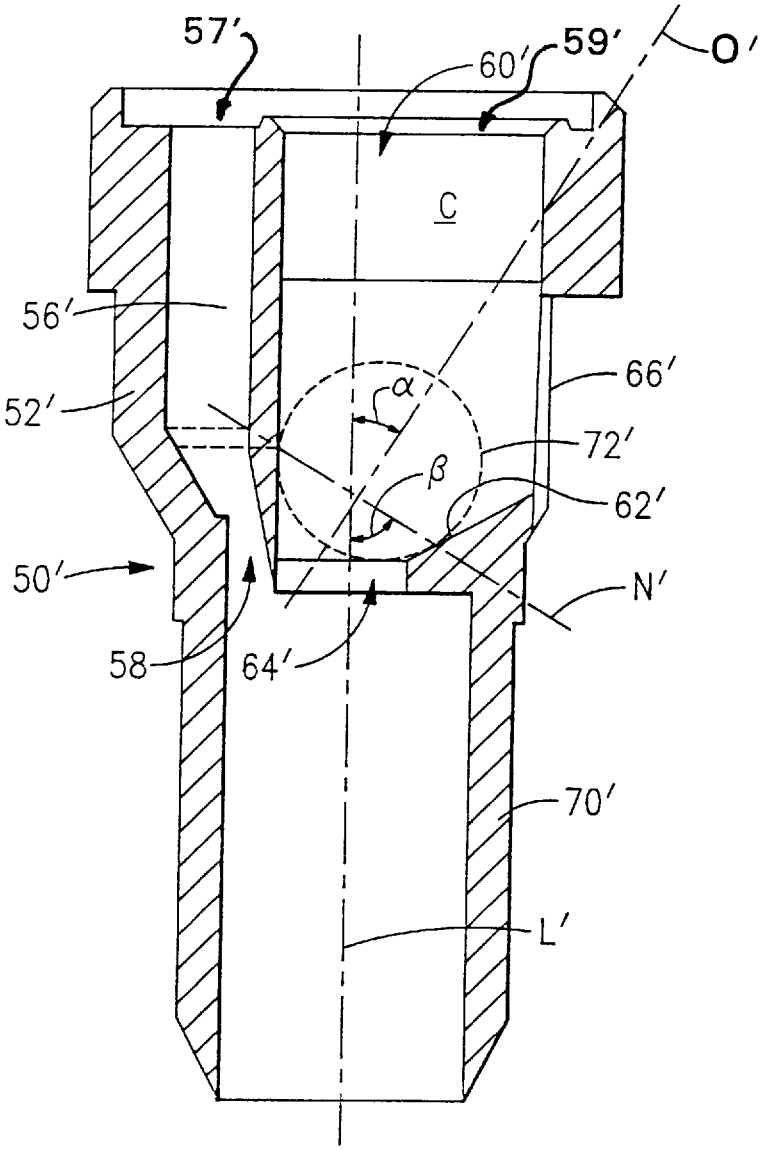
FIG. 8 is a diagrammatic cross-sectional view showing a fourth embodiment of the improved valve, according to the present invention, in which the valve body and the appendage are formed as a single unitary structure.
Figure 9:
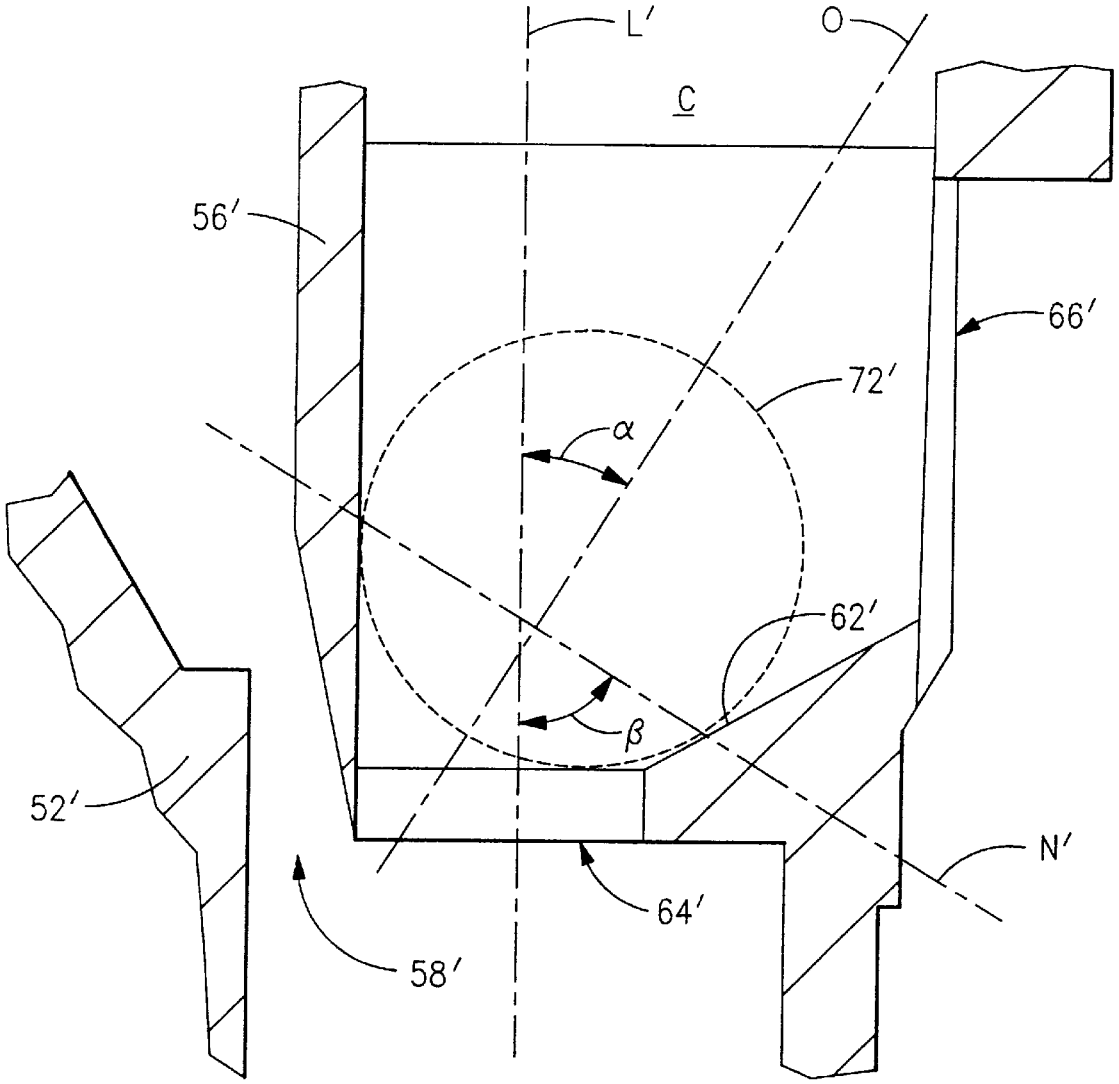
FIG. 9 is an exploded diagrammatic cross-sectional view of FIG. 8 showing the orientation of ball seated on the ball chamber seat.

Turning now to FIGS. 8 and 9, a detailed description concerning a broadest form of the present invention will now be provided. As with the previous embodiments, a bypass appendage 50' forms a lower portion of the valve and has a substantially circular side wall 52' which is frictionally and sealingly engaged in the socket, or formed as a single component therewith. The appendage 50' is partitioned, by an inner partition wall 56', into a primary product passage 58' and a ball chamber 60'. An opening 57' of the upper end of the product passage 58' of the appendage 50' and an opening 59' of the ball chamber 60' of the appendage 50', remote from the ball chamber bypass opening 64', are coplanar with one another and are both received within said socket.

A lower end of the ball chamber 60' is provided with a conical ball chamber seat 62' having a central ball chamber bypass opening 64'. The ball chamber 60' is provided with a gravity-responsive ball chamber ball 72' which normally rests, under the force of gravity, on the ball chamber valve seat 62' closing off ball chamber bypass opening 64'. The perimeter contact between the ball chamber seat 62' and the ball 72', when the ball 72' is supported by the ball chamber seat 62', defines a ball chamber plane N'. Axis O is normal to plane N', extends through the center of seat 62', and the ball 72', when the ball is seated on the ball chamber seat 62', and perferably intersects with longitudinal axis L' of the valve.

A ball chamber passage 66' extends through the side wall 52', above the ball chamber seat 62', into the ball chamber 60'. The side wall 52' of the appendage 50' tapers inwardly 68' and connects with a dip tube tail-piece or nipple 70' for receiving an upper end of a dip tube 71' (not shown in these figures). The nipple 70' is tubular and the upper end communicates with both the primary product passage 58' and the ball chamber bypass opening 64'. As with the previous embodiments, a lower end of a dip tube communicates with a forward, relative to the direction of spray, lower corner of a container.

The ball chamber plane N' intersects with longitudinal axis L' of the valve and forms therewith an angle $\beta$ of from about 89° to about 1°. Preferably, angle $\beta$ is from about 85°0 to about 5°, more preferably about 80° to about 10°, still more preferably from about 70°to about 40°, and most preferably about 60°.

The inventors have determined that the most critical aspect of the present invention is manner in which the ball 72' is supported by the ball chamber seat 62'. The surface contact between the ball 72' and the ball chamber seat 62' determines the position at which the ball 72' will initially become unseated from the ball chamber seat 62'. The relationship between the ball chamber plane N', defined by the perimeter contact between the ball 72' and the ball chamber seat 62' when the ball 72' is seated thereon, and the longitudinal axis L' of the valve is critical in maintaining the ball 72' in a seated, sealed position while utilizing a container incorporating a valve according to the present invention. By proper design of the components, the ball can remain seated in virtually any desired range of motion.

When these two components are in their engaged position, the ball chamber bypass opening 64' is sealed off to prevent the flow of the container contents along the secondary flow path B' via the ball chamber passage 66'. However, once the ball 72' becomes unseated from the ball chamber seat 62', a flow of the container contents along the secondary flow path B' is established. The direction in which the ball 72' rolls or moves, once the ball 72' is unseated, is not important as long as the container contents can flow along the secondary flow path B' in a substantially unhindered or unobstructed manner. That is, the ball chamber 60' must merely provided an area or cavity C' for accommodating the ball 72', once it is unseated, so that the ball 72' does not hinder or obstruct flow of the container contents along the secondary flow path B'.

It is to be appreciated that the design of FIGS. 8 and 9 is able to be manufactured in a two-part mold having a single separating action while the previous embodiments may require a three part mold having a more complicated mold separation motion in order to manufacture the bypass appendage 50'. Accordingly, the embodiment of FIGS. 8 and 9 is easier and cheaper to produce while, at the same time, still providing suitable sealing and unsealing of the ball chamber bypass opening 64'.

It is to be appreciated that the teaching of the present invention is applicable to virtually any type of currently known valve used to dispense product from a container provided that the arrangement of the critical components, e.g. the ball chamber, the lower end of the dip tube, and the orifice, is maintained. In addition, the degree of inclination of the ball chamber longitudinal axis or ball chamber plane relative to the valve body longitudinal axis may vary depending upon the application. The range of movement permitted by the prior art valves, before the ball would become unseated from its ball chamber valve seat, was approximately 60° of forward tilt of the container as well as approximately 60° of rearward tilt of the container relative to the upright vertical axis of the container. By appropriate inclining of the ball chamber longitudinal axis or ball chamber plane relative to the valve body longitudinal axis, the valve made according to the present invention is able to increase or decrease, as desired, the amount of forward tilt of the container which is permissible before the ball becomes unseated. It is to be appreciated, however, that any increase in the amount of forward tilt permitted by inclination of the ball chamber longitudinal axis relative to the valve body longitudinal axis or the ball chamber plane produces a corresponding decrease in the permissible amount of rearward tilt of the container, and vice-versa. That is, if the ball chamber longitudinal axis and/or ball chamber plane is inclined in a clockwise direction (FIGS. 4 and 5) to an angle of 30° and 60°, respectively, with respect to the valve body longitudinal axis, the container is able to tilt forward 30° more than a prior art valve before the ball becomes unseated. However, such 30° inclining of the ball chamber longitudinal axis and 60° inclining of the ball chamber plane will cause the ball, as the container is tilted rearward, to become unseated at an orientation which is about 30° less than the permissible rearward tilt permitted by a prior art valve before the ball becomes unseated. The orientation of the ball chamber longitudinal axis or the ball chamber plane relative to the valve body longitudinal axis may be varied, as desired, to achieve virtually any desired range of permissible tilt of a container, containing a valve according to the present invention, without the ball becoming unseated.

It is to be appreciated that the appendage 50' and the valve body 12' may, depending upon the application, be molded as a single component (FIG. 6) instead of two separate components as shown in FIGS. 3–5 and 7–9 of the drawings. Further, the modified appendage 50', 50" according to the present invention can be installed on existing valves, if desired, or incorporated into all types of spray valves, e.g. an aerosol valve, a tilt valve, a pump spray valve, a trigger spray valve, etc., for use in dispensing product from an container.

Since certain changes may be made in the above described improved valve, without departing from the spirit and scope of the invention herein involved, it is intended that all of the subject matter of the above description or shown in the accompanying drawings shall be interpreted merely as examples illustrating the inventive concept herein and shall not be construed as limiting the invention.

Wherefore, we claim:

1. An invertible valve comprising a valve body accommodating a valve element for controlling flow through the valve, the valve body defining a valve body longitudinal axis, the valve element having passage means, communicating with a product passage, for discharging product from the valve when the valve is opened, the valve body having a socket, at a lower end thereof, containing a product outlet, the socket receiving an appendage having a ball chamber and a valve inlet product passage, the ball chamber being provided with a ball chamber passage and a ball chamber bypass valve seat having a ball chamber bypass opening, a lower end of the product passage communicating with the ball chamber bypass opening while an upper end thereof communicating, via the product outlet of the socket, with the valve element, and a gravity-responsive ball chamber ball being provided in the ball chamber and normally seating on the ball chamber seat, the ball chamber providing an area for accommodating the ball when the ball becomes unseated from the ball chamber seat, a perimeter contact between the ball chamber seat and the ball, when the ball is supported thereby, defining a ball chamber plane, and the ball chamber ball moving from the ball chamber seat when the valve is sufficiently inverted to permit passage of product through the ball chamber passage into the ball chamber, through the ball chamber bypass opening, through the product passage into the valve body and out the passage means when the valve is opened;

wherein the ball chamber plane is inclined relative the valve body longitudinal axis at an angle of between from about 5° to about 85° and, an opening of the upper end of the product passage of the appendage and an opening of the ball chamber of the appendage, remote from the ball chamber bypass opening, are coplanar with one another and are both received within the socket.

2. An invertible valve according to claim 1, wherein a nipple is connected to and communicates with the product passage and the ball chamber bypass opening and a dip tube is connected to a remote end of the nipple, and an inner partition wall separating the ball chamber from the product passage has a constant wall thickness substantially along a length thereof.

3. An invertible valve according to claim 1, wherein the ball chamber is circular in transverse cross-section.

4. An invertible valve according to claim 3, wherein the ball chamber plane is inclined relative the valve body longitudinal axis at an angle ranging from about 40° to about 70°.

5. An invertible valve according to claim 4, wherein the ball chamber plane is inclined relative the valve body longitudinal axis at an angle of about 60°.

6. An invertible valve according to claim 2, further comprising an actuator button which has a discharge orifice for dispensing product from the valve, the actuator button is supported by the valve element such that the discharge orifice communicates with the passage means for dispensing product from the valve.

7. An invertible valve according to claim 1, wherein the valve is an aerosol valve and the aerosol valve is secured to an opening provided in a container, via a mounting cup, and the container is pressurized with a propellant and provided with a product to be dispensed.

8. An invertible valve according to claim 1, further comprising an actuator button which has a discharge orifice for dispensing product from the valve, the actuator button is supported by a piston supported by the valve element such that the discharge orifice communicates with the passage means for dispensing product from the valve.

9. An invertible valve comprising:

a. a valve body having a side wall extending downwardly to define a lower portion of the valve body and having an outlet formed therein, an upper portion of the valve body defining an interior cavity communicating with valve discharge, passage means and the outlet for dispensing product from the valve, and the side wall of the valve body defining a valve body longitudinal axis;

b. a valve element being accommodated within the valve body for controlling product flow from the outlet to the passage means;

c. a dip tube for supplying product to the valve;

d. an appendage being attached to the lower portion of the valve body, the appendage supporting a product passage interconnecting one end of the dip tube with the outlet;

e. the appendage further supporting a ball chamber communicating with the product passage, the ball chamber being provided with a ball chamber passage and a ball chamber valve seat having a ball chamber bypass opening, a gravity-responsive ball chamber ball being located within the ball chamber and normally seating on the ball chamber seat, a perimeter contact between the ball chamber seat and the ball, when the ball is supported thereby, defining a ball chamber plane, and the ball chamber ball moving from the ball chamber seat when the valve is sufficiently inverted to permit passage of product through the ball chamber passage into the ball chamber, through the ball chamber bypass opening, through the product passage into the valve body and out the passage means when the valve is opened;

wherein the ball chamber plane is inclined relative the valve body longitudinal axis at an angle of between from about 5° to about 85° and an opening of an upper end of the product passage of the appendage and an opening of the ball chamber of the appendage, remote from the ball chamber bypass opening, are coplanar with one another and are both received within a socket.

10. An invertible valve according to claim 9, wherein the ball chamber is circular in transverse cross-section.

11. An invertible valve according to claim 10, wherein the ball chamber plane is inclined relative the valve body longitudinal axis at an angle ranging from about 40°0 to about 70°.

12. An invertible valve according to claim 11, wherein the ball chamber plane is inclined relative the valve body longitudinal axis at an angle of about 60°.

13. An invertible valve according to claim 9, further comprising an actuator button which has a discharge orifice for dispensing product from the valve, the actuator button is supported by a piston of the valve element such that the discharge orifice communicates with the passage means for dispensing product from the valve.

14. An invertible valve according to claim 9, wherein the valve is an aerosol valve and the aerosol valve is secured to an opening provided in a container, via a mounting cup, and the container is pressurized with a propellant and provided with a product to be dispensed.

15. An invertible valve comprising a valve body accommodating a valve element for controlling flow through the valve and out through passage means, the valve body defining a valve body longitudinal axis, the valve body having a socket, at a lower portion thereof, with a product outlet being located within the socket, the socket including a retaining mechanism for receiving an appendage supporting both a product passage and a ball chamber, the appendage carrying a retaining mechanism for mating with the retaining mechanism of the socket, the ball chamber being provided with a ball chamber passage and a ball chamber bypass valve seat having a ball chamber bypass opening, the product passage communicating with the ball chamber bypass opening, and a gravity-responsive ball being provided in the ball chamber and normally seating on the ball chamber seat to close the ball chamber bypass opening, and a perimeter contact between the ball chamber seat and the ball, when the ball is supported thereby, defining a ball chamber plane, and the ball chamber ball moving from the ball chamber seat when the valve is inverted to permit passage of product through the ball chamber passage into the ball chamber, through the ball chamber bypass opening, through the product passage into the valve body, via the product outlet of the socket, and out the passage means when the valve is opened;

wherein the ball chamber plane is inclined relative the valve body longitudinal axis at an angle of between from about 5° to about 85° and, an opening of an upper end of the product passage of the appendage and an opening of the ball chamber of the appendage, remote from the ball chamber bypass opening, are coplanar with one another and are both received within the socket.

16. A method of forming an invertible valve comprising the steps of:

accommodating, within a valve body, a valve element for controlling flow through the valve, the valve body defining a valve body longitudinal axis;

providing passage means in the valve element for discharging product from the valve when the valve is opened, the valve body having a socket, at a lower portion thereof, with a product outlet being located within the socket, the socket including a retaining mechanism for receiving an appendage supporting both a product passage and a ball chamber, the appendage also supporting a retaining mechanism for mating with the retaining mechanism of the socket;

providing the ball chamber with a ball chamber passage and a ball chamber bypass valve seat having a ball chamber bypass opening, a lower end of the product passage communicating with the ball chamber bypass opening while an upper end thereof communicating with the valve element, via the product outlet of the socket;

accommodating a gravity-responsive ball chamber ball in the ball chamber and normally seating the ball on the ball chamber seat, the ball chamber providing an area for accommodating the ball when the ball becomes unseated from the ball chamber seat, the ball chamber ball moving from the ball chamber seat when the valve is inverted to permit passage of product through the ball chamber passage into the ball chamber, through the ball chamber bypass opening, through the product passage and product outlet of the socket into the valve body and out the passage means when the valve is opened;

defining a ball chamber plane by a perimeter contact between the ball chamber seat and the ball, when the ball is supported thereby;

inclining the ball chamber plane relative the valve body longitudinal axis at an angle of between from about 5° to about 85°;

forming an opening in an upper end of the product passage of the appendage and an opening in the ball chamber of the appendage, remote from the ball chamber bypass opening, to be coplanar with one another; and receiving both coplanar openings within the socket.

* * * * *